US009657524B2

(12) United States Patent
Klein et al.

(10) Patent No.: US 9,657,524 B2
(45) Date of Patent: May 23, 2017

(54) DRILLING APPARATUS

(71) Applicant: Keller Holding GmbH, Offenbach/Main (DE)

(72) Inventors: Kuno Klein, Offenburg (DE); Alexandra Baumert, Offenburg (DE)

(73) Assignee: Keller Holding GmbH, Offenbach/Main (DE)

( * ) Notice: Subject to any disclaimer, the term of this patent is extended or adjusted under 35 U.S.C. 154(b) by 428 days.

(21) Appl. No.: 14/219,387

(22) Filed: Mar. 19, 2014

(65) Prior Publication Data

US 2014/0284107 A1 Sep. 25, 2014

(30) Foreign Application Priority Data

Mar. 20, 2013 (EP) ..... 13160119

(51) Int. Cl.
*E21B 7/02* (2006.01)
*E21B 7/00* (2006.01)
*E21B 3/02* (2006.01)

(52) U.S. Cl.
CPC ..... *E21B 7/00* (2013.01); *E21B 3/02* (2013.01); *E21B 7/023* (2013.01); *E21B 7/024* (2013.01)

(58) Field of Classification Search
CPC ..... E21B 7/023; E21B 15/04; E21B 15/045
See application file for complete search history.

(56) References Cited

U.S. PATENT DOCUMENTS 1,885,295 A * 11/1932 Robinson ..... E21B 7/025 15/104.095
4,627,499 A * 12/1986 Magee ..... E21B 7/025 173/193
6,179,068 B1 1/2001 West
2004/0178004 A1 9/2004 MacDonald

FOREIGN PATENT DOCUMENTS

DE 1483853 11/1966
DE 3625577 3/1987
DE 102008037338 2/2010

OTHER PUBLICATIONS

Klemm Bohrtechnik Flyer "KR 702-1", © 2003, 6 pages.

* cited by examiner

*Primary Examiner* — David Andrews
(74) *Attorney, Agent, or Firm* — Bejin Bieneman PLC

(57) ABSTRACT

The invention relates to a small drilling apparatus for producing bores in the ground, comprising, a main carrier 4, a telescopic mast 7 with an adjustable length, a rotating device 6, by which the telescopic mast 7 is pivotable relative to the main carrier 4 around a vertical axis A1.

11 Claims, 5 Drawing Sheets

Figure 2:
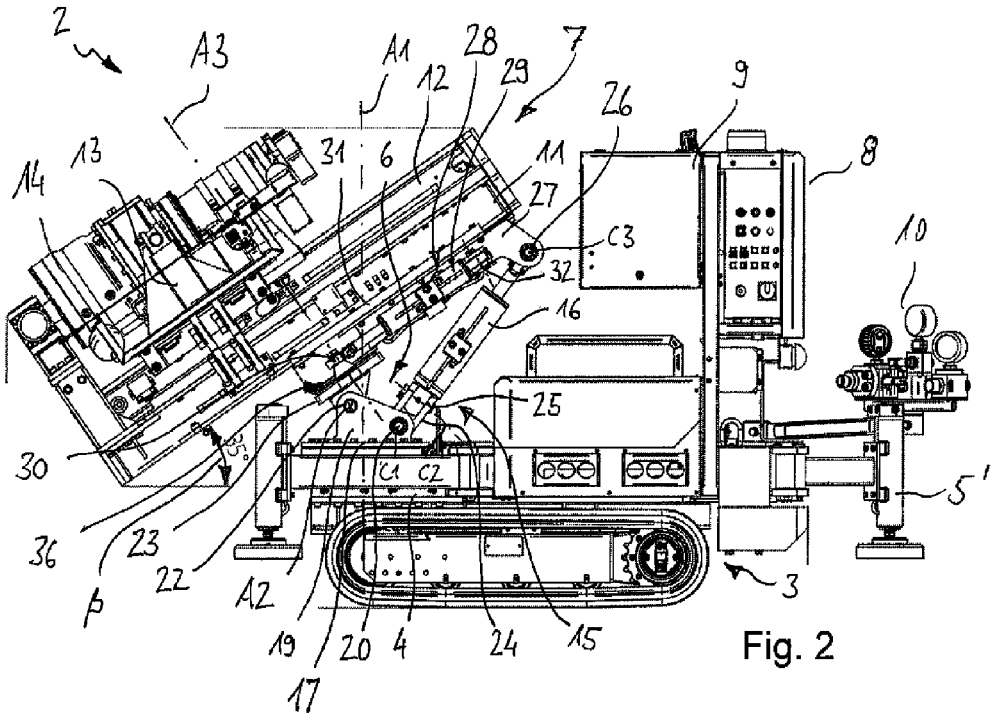

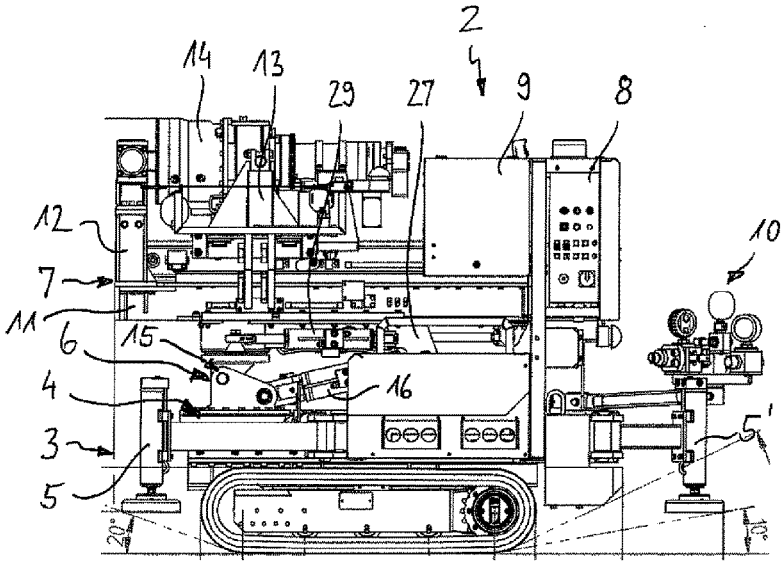
Fig. 1a
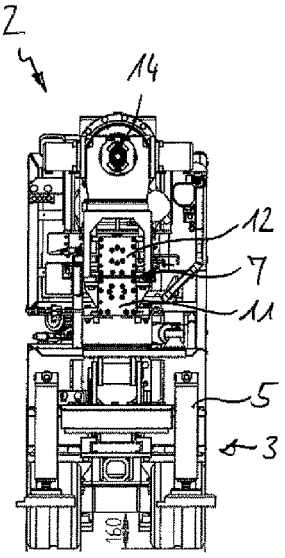
Fig. 1b
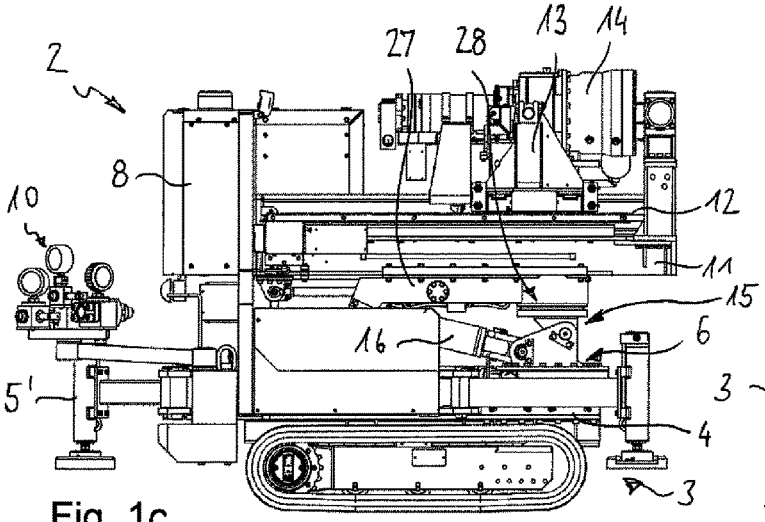
Fig. 1c
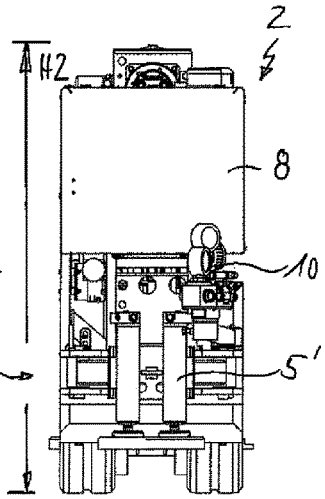
Fig. 1d
Fig. 1e
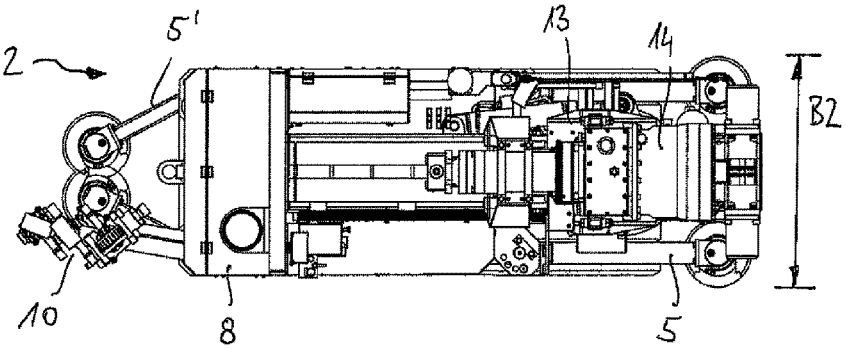

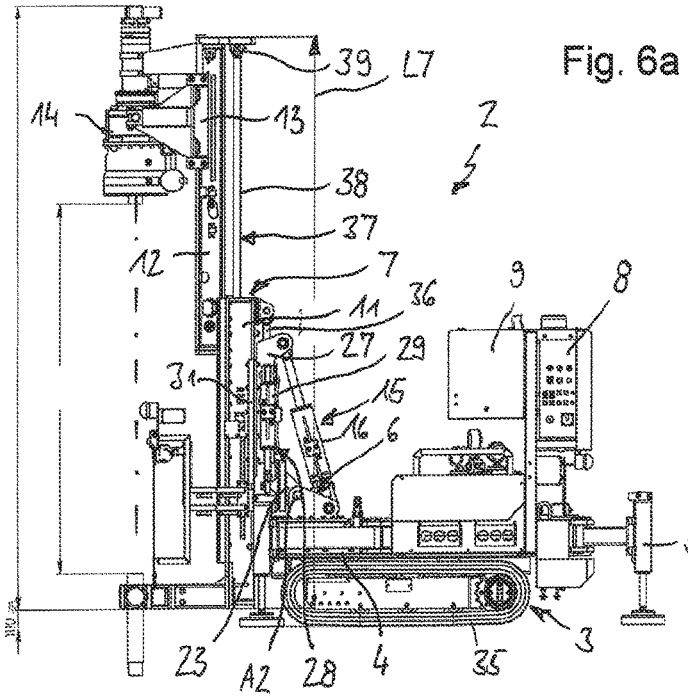
Fig. 6a
Fig. 6b
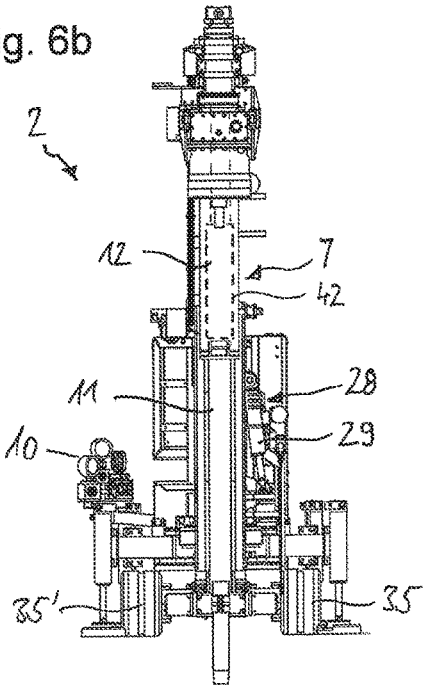
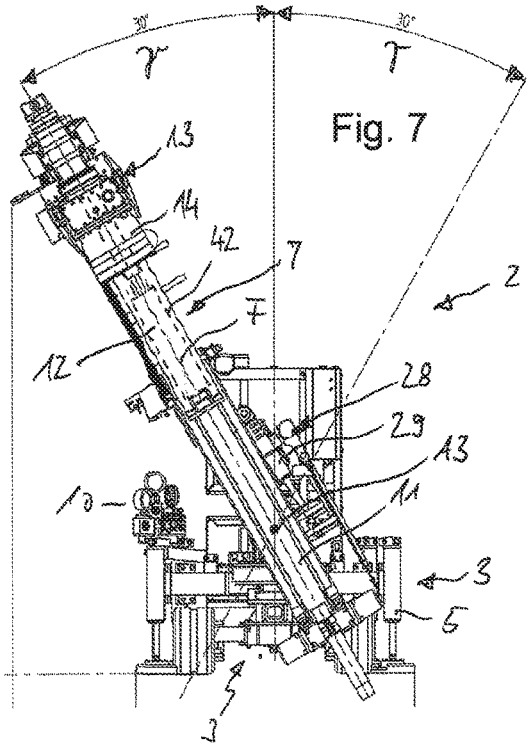
Fig. 7

DRILLING APPARATUS

CROSS-REFERENCE TO RELATED APPLICATIONS

This application claims priority to European application EP 131601197, filed Mar. 20, 2013, the contents of which are hereby incorporated herein by reference in their entirety.

BACKGROUND

The disclosure relates to a mobile drilling apparatus for producing bores in the ground.

From DE 36 25 577 A1 a small drilling apparatus is known for producing bores in the ground. The small drilling apparatus has a drill mast, on which a drill slide is vertically guided, a feed device, connected detachably to the drill slide, a drill drive, a rope winch with a rope and a rope guide via a diverting device at the upper end of the drill mast.

From DE 1 483 853 A1 a drill rig with a mast, held adjustably concerning its inclination or angular position, and drive means for a drill tool or drill rods, is known.

From the product leaflet "KR 702-1" of the company Klemm Bohrtechnik a small drilling apparatus is known, which has a telescopic drill mast.

Especially in tight spaces, for example in rooms or in corridors, which are limited by their room width or room height, it is difficult to carry out ground bores. To adapt the drill rod length to the room height, it can be necessary, to exchange the drill mast, which means a considerable effort for the retooling.

SUMMARY

Starting therefrom, a small drilling apparatus is disclosed, which enables a variable adaptation to different space conditions, such as passing through width or room height without retooling.

A solution is a small drilling apparatus for producing bores in the ground, comprising: a main carrier, a telescopic mast with an adjustable length, and a rotating device, by which the telescopic mast is pivotable relative to the main carrier around a vertical axis (A1). The drilling apparatus may also be referred to as drill rig.

According to the present disclosure, a drill tool attached to the telescopic mast can quickly be moved into different drill positions because of the combination of telescopability and pivotability of the mast around a vertical axis. Thus bores close to building walls can be produced with the small drilling apparatus, without having to move the drill rig. Because of the telescopability of the mast, longer drill rods can be used, so that the setting up time and thus the drill time can overall be reduced.

According to the present disclosure, a small drilling apparatus has relatively compact dimensions, so that it can be used in tight space conditions. The dimensions of the small drilling apparatus are selected such, that it can be moved through doors with standard dimensions. In one example, the small drilling apparatus has a maximum width of 760 mm and a maximum height of 1900 mm in the folded-in position of the individual assembly units. Thus, the device can be used in buildings, for example for producing foundation underpinnings For this, the drilling apparatus is moved into the building to the required position. Then, it drills through the foundation of the building and a bore is sunk into the ground arranged below. Then a curable suspension is injected through the drill rods into the ground.

According to an example, the small drilling apparatus is constructed as a mobile device, i.e. a self-propelled vehicle with a drive for moving.

According to one example, the length of the telescopic mast is continuously adjustable such, that drill rods with a length of 0.5 m up to a maximum of 2.5 m can be accommodated, wherein in principle also other lengths may be considered. For producing bores with a depth, which is larger than the length of the drill rod, several drill rod elements are connected to each other and are sunk one after the other, until the required overall depth is achieved.

The telescopic mast is rotatable relative to the main carrier, starting from a center position, around the vertical axis of rotation across an angle range of up to ±90°. In the center position, the telescopic mast is positioned substantially in the center plane of the drilling apparatus, whereas the telescopic mast is moved out of the center plane in the pivoted position. When the telescopic mast is aligned vertically, the distance of the axis of rotation of the rotary head to the vertical pivot axis is larger than the largest half-width of the drilling apparatus. In this manner, also bores can be produced laterally next to the drilling apparatus in a position of the telescopic mast, pivoted around the vertical axis. The drilling apparatus does not need to be moved for this.

According to one example, the rotating device, which can also be designated as a first pivot device, has a rotary element as well as a rotary drive, by which the rotary element is rotatingly driveable relative to the main carrier. The rotary drive can be designed in the form of a hydraulic rotary drive, by which the rotary element can be rotated, starting from a center position, clock-wise or anti-clockwise. In this case, the telescopic mast, when turning clockwise, is pivoted to the right and, when turning anti-clockwise, it is turned to the left side of the drilling apparatus. The rotary element carries the telescopic mast, because of which it can also be designated as a support element. The rotary element can have a flange-like plate and, projecting therefrom, two holding portions for supporting the mast assembly. The holding portions can be formed as two side walls which are arranged opposite to each other and extend from the plate.

According to one example, a tilting device is provided, by which the telescopic mast is pivotable around a horizontal tilting axis (A2). The tilting device can also be referred to as a second pivot device and the tilting axis can also be referred to as a second pivot axis. The tilting device is mounted on the rotating device, so that the tilting device rotates with the latter around the vertical axis. The connection is achieved, in one example, via a bearing, through which a tilting element of the tilting device is pivotably supported relative to the rotary element of the rotary device around the horizontal tilting axis. The tilting device comprises further a tilting drive, which is supported relative to the rotary element and serves for pivoting the tilting element.

Furthermore, according to one example, a third pivot device is provided, by which the telescopic mast is pivotable around a third pivot axis (A3), wherein this third pivot axis extends at a right angle to the horizontal tilting axis. The third pivot axis is formed by a pivot bearing on the tilting element, i.e. during the pivoting of the tilting element around the tilting axis (A2), the third pivot axis (A3) is pivoted together with the tilting element.

Through the use of three pivot devices, the telescopic mast can be pivoted around altogether three axes (A1, A2, A3). In this manner, bores with any deliberately selected alignment can be produced or the drill tool can be positioned, without having to move the vehicle. In one example, the pivot device has a carrier element, which is rotatably supported relative to the tilting element around the third pivot axis, as well as a pivot drive, which is supported relative to the tilting element and serves for pivoting the carrier element. The telescopic mast is mounted on the carrier element.

The telescopic mast can be pivoted or tilted, respectively, from a generally horizontal rest position, in which the mast rests on the device, into a for example vertical operational position. The tilting device comprises, in one example, a hydraulic cylinder as a drive, which is arranged with a distance to the tilting bearing, to produce a torque around the tilting axis (A2) when actuated. The hydraulic cylinder is, in one example, connected in an articulated manner via an intermediate element, which is supported in an articulated manner to the rotary element of the rotating device. In this case, a first joint enables a tilting movement of the hydraulic cylinder when tilting the mast around the tilting axis (A2), while a second joint enables the pivoting movement of the hydraulic cylinder during lateral pivoting of the mast around the pivot axis (A3). The hydraulic cylinder is pivotably supported with its second end on the carrier element for the telescopic mast.

In one example, at least one of the rotary drive for the rotating device, the tilting drive for the tilting device and/or the pivot drive for the pivot device are hydraulically actuated, and comprise more particularly one or more hydraulic cylinders.

According to one example, the telescopic mast comprises a first mast portion and a second mast portion, which is telescopic thereto, wherein a first hydraulic cylinder is provided for moving the second mast portion relative to the first mast portion. According to a further example, a slide with a rotary head is mounted for driving the drill rods on the telescopic mast portion, wherein the slide is moveable along the telescopic mast portion by a second hydraulic cylinder. In particular, the first hydraulic cylinder for displacing the telescopic mast portion and the second hydraulic cylinder for displacing the slide are configured such that they move with the same feed rate. This is advantageous for an accurate control of the drill speed as well as the extracting speed, so that a bore can be drilled and a suspension can be injected evenly into the ground at a unitary feed rate.

In one example, the drilling apparatus comprises an independently driveable undercarriage, especially a crawler or chain chassis. The undercarriage is expandable according to an exemplary embodiment in the width direction, wherein each side of the undercarriage can be expandable separately. Because of the expandability, an improved support and an increased stability are achieved during driving.

Support elements, which can be unfolded before the drill procedure and which provide a safe standing of the main carrier during the drill procedure and for a good support, are foldably or hingedly mounted on the main carrier, which is mounted on the carriage. In one example, the front support elements are individually controllable and extendable, each via a respective hydraulic cylinder. The two rear support elements are, in one example, together controllable and extendable via respectively one hydraulic cylinder. These hydraulic cylinders for the rear support elements are connected to each other via a hydraulic duct, so that a hydraulic balancing takes place automatically in the two hydraulic cylinders. Thus, it is prevented, that the small drilling apparatus lifts off on one side during the support procedure at uneven ground conditions.

DRAWINGS

Following, exemplary embodiments are described by using the drawings.

FIG. 1*a* is a first side view of a small drilling apparatus for producing bores in the ground.

FIG. 1*b* is a front view of the small drilling apparatus of FIG. 1*a*.

FIG. 1*c* is a second side view of the small drilling apparatus of FIG. 1*a*.

FIG. 1*d* is a rear view of the small drilling apparatus of FIG. 1*a*.

FIG. 1*e* is a top view of the small drilling apparatus of FIG. 1*a*.

FIG. 2 is a side view of the small drilling apparatus of FIGS. 1*a-e* with the telescopic mast partially tilted around the horizontal tilting axis (A2).

Figure 3C:
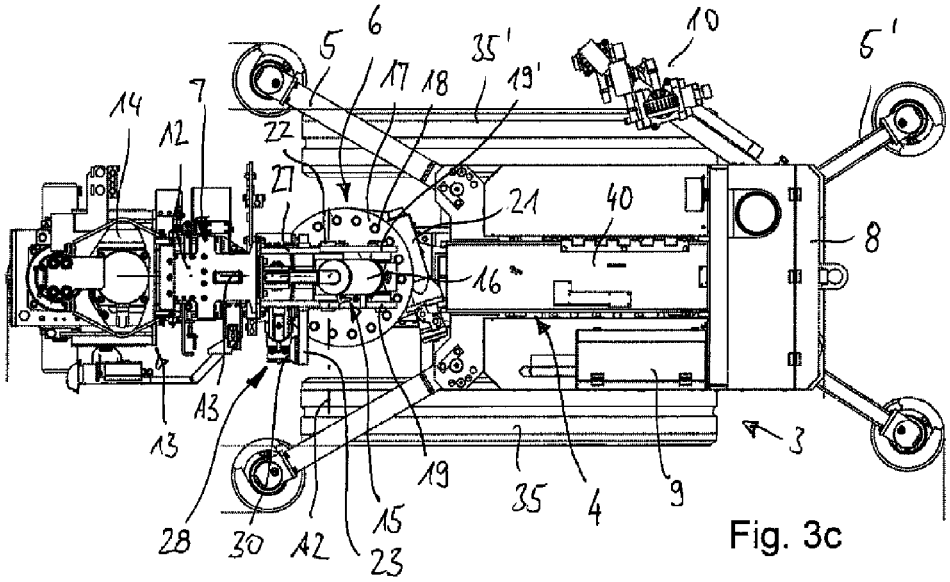
Figure 3A:
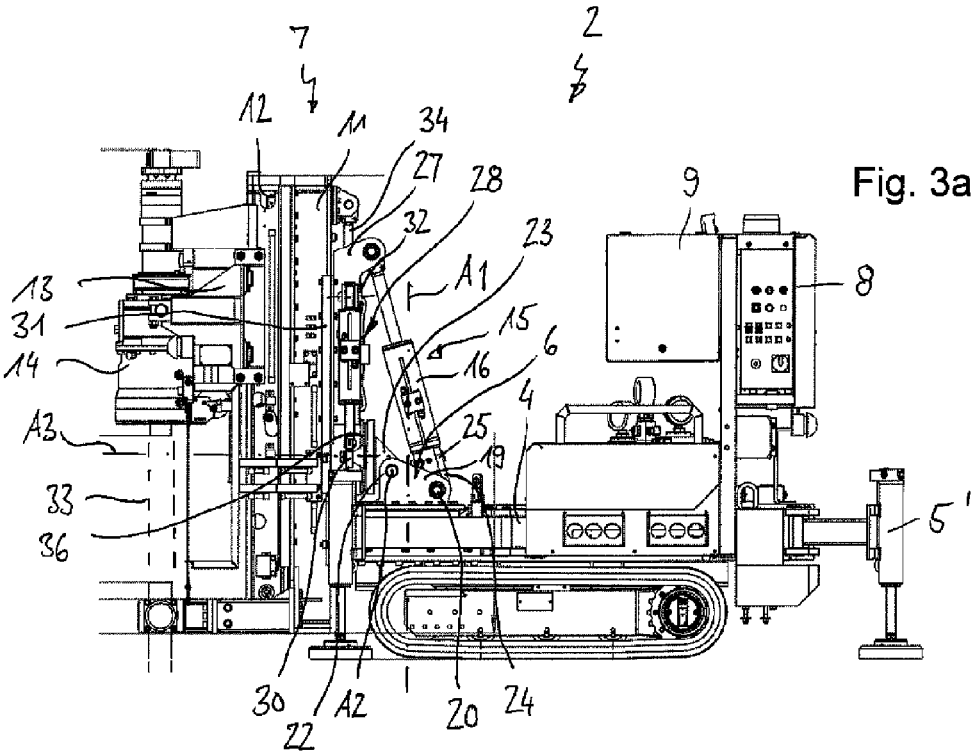

FIG. 3*a* is a side view of the small drilling apparatus of FIGS. 1*a-e* in an operational position with the telescopic mast tilted by approximately 90° around the tilting axis (A2).

Figure 3B:
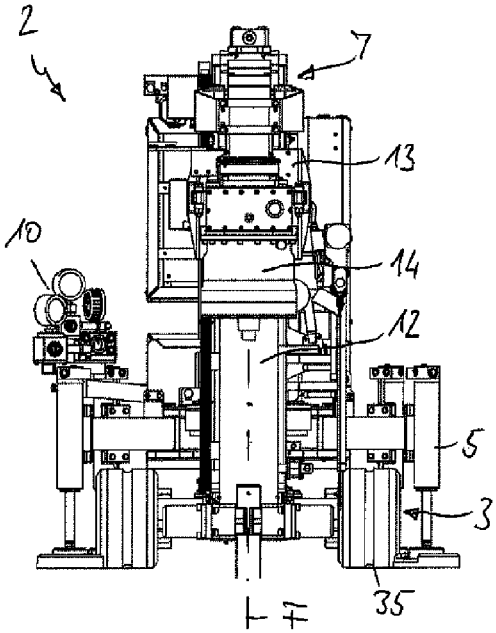

FIG. 3*b* is a front view of the small drilling apparatus of FIG. 3*a*.

FIG. 3*c* is a top view of the small drilling apparatus of FIG. 3*a*.

Figure 4A:
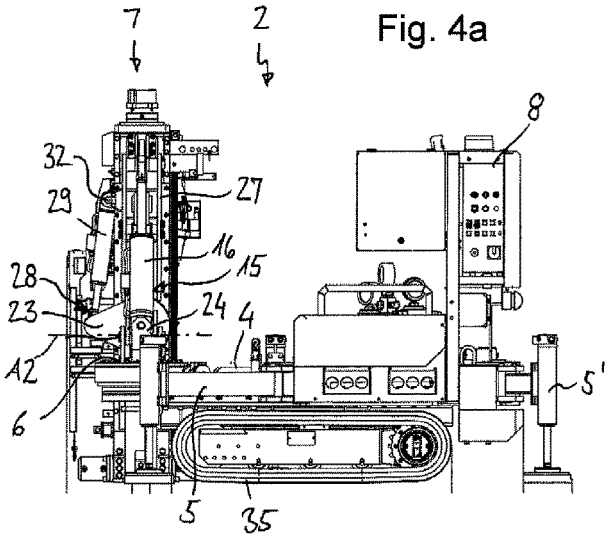

FIG. 4*a* is a side view of the small drilling apparatus according to FIGS. 3*a-c* in an operational position with the telescopic mast pivoted around the axis of rotation (A1) by approximately 90°.

Figure 4B:
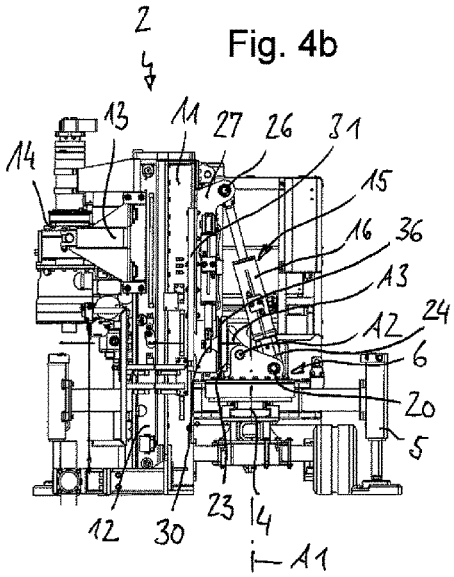

FIG. 4*b* is a front view of the small drilling apparatus of FIG. 4*a*.

Figure 4C:
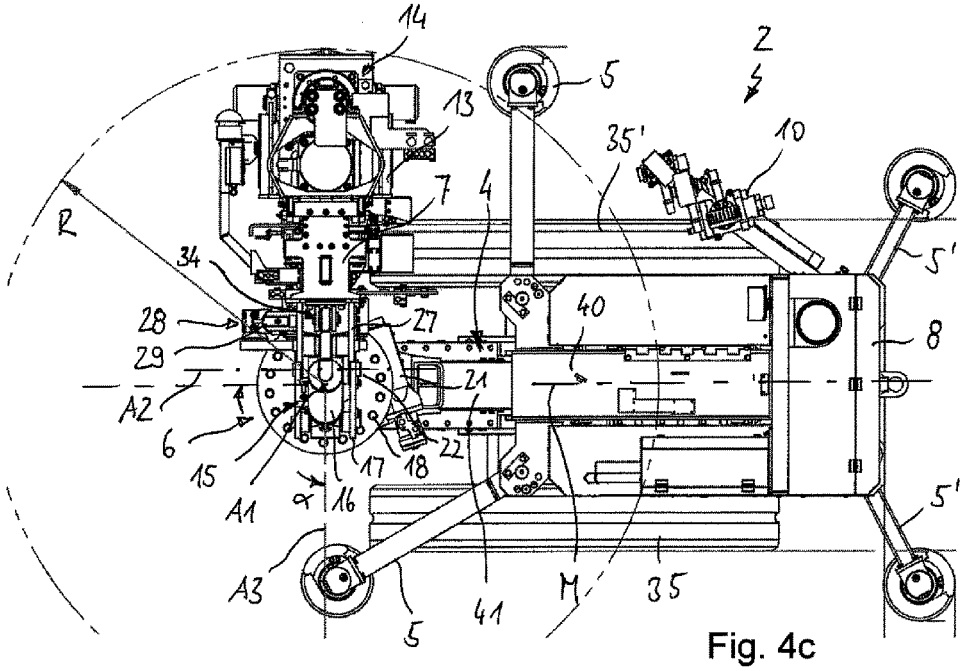

FIG. 4*c* is a top view of the small drilling apparatus of FIG. 4*a*.

Figure 5:
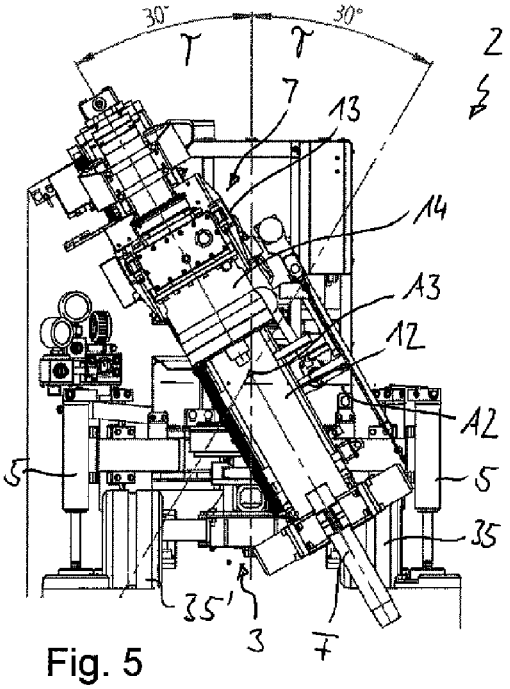

FIG. 5 is a front view of the small drilling apparatus according to FIGS. 3*a-c* with the telescopic mast pivoted around the pivot axis (A3) by approximately 30°.

FIG. 6*a* is a side view of the small drilling apparatus according to FIGS. 3*a-c* with an extended telescopic mast.

FIG. 6*b* is a front view of the small drilling apparatus of FIG. 6*a*.

FIG. 7 is a front view of the small drilling apparatus according to FIGS. 6*a-b* with the telescopic mast pivoted around the pivot axis (A3) by approximately 30°.

DETAILED DESCRIPTION

FIGS. 1*a* to 1*e*, which are described together, show a small drilling apparatus 2 for producing bores in the soil. In this disclosure, small drilling apparatus means that the same can drive through doors with standard dimensions. It is especially provided, that a machine width is smaller or equal to 760 mm in the folded condition of the individual machine elements and the maximum height is approximately 1900 mm. In this manner, it is ensured, that the small drilling apparatus 2 can pass through a door opening, so that it is especially also suitable for producing the underpinning of foundations in buildings below the foundations of the building.

The small drilling apparatus 2 comprises a driveable undercarriage 3 with a crawler chassis, respectively carriage. A main carrier 4 is mounted on the undercarriage, which can be supported relative to a stationary ground via in total four support elements 5, 5', which are each pivotable around a respective vertical axis and adjustable in their heights. In this case, it is provided that the front support elements 5 are individually controllable, without a hydraulic balancing amongst each other. In contrast thereto, the rear support elements 5' are hydraulically connected to each other, so that these can be extended and refracted together.

A rotating device 6 is mounted on the main carrier 4, with which the telescopic mast 7 is pivotable relative to the main carrier 4 around a vertical axis A1. Furthermore, a control cabinet 8 as well as a measuring system 9 are visible. The small drilling apparatus comprises further measuring devices 10, like a manometer or hydraulic measuring devices for the service drives as well as measuring devices for suspensions injected into the bore, if necessary.

The telescopic mast 7 is adjustable in its length and has for this a first mast portion 11 as well as a second mast portion 12 longitudinally displaceable relative thereto. A head carriage 13 is mounted longitudinally movably on the second mast portion 12, on which a rotary head 14 is mounted for accommodating and driving drill rods. The rotary head 14 can also be referred to as a drill head. The length L7 of the telescopic mast 7 is continuously adjustable such, that drill rods with a length of 0.5 m up to a maximum of 2.0 m can be accommodated.

FIG. 2 shows the small drilling apparatus 2 of FIG. 1*a*, wherein the telescopic mast 7 is pivoted relative to the main carrier 4 with a tilting device 15 around a tilting axis A2 by an angle β of approximately 35° relative to a horizontal starting, respectively resting position. The tilting device 15 is connected to a component of the rotating device 6 in an articulated manner and supported thereon. The rotating device 6 comprises a rotary drive 21, which is especially formed in the form a hydraulic rotation drive. The carrier of the mast 7 can be pivoted around the vertical axis A1 with the rotary drive 21. For this, the rotating device 6 comprises a flange- or plate-like rotary element 17 connected via a multitude of screw connections 18 to a rotatably drivable basic body arranged below said rotary element 17. The rotary element 17 has a basic plate and two holding elements 19, 19' fixed thereto which can also be referred to as supporting elements. The two holding elements 19, 19' are configured in the form of sidewalls which are arranged at a distance to each other. The two holding elements 19, 19' jointly accommodate a first bearing 20 for pivotably supporting a tilting drive 16 of the tilting device 15 and a second bearing 22 for pivotably supporting a tilting element 23 of the tilting device 15.

The tilting drive 16 is formed in the form of a hydraulic cylinder, wherein other tilting drives are not excluded. The hydraulic cylinder 16 is pivotably supported via an intermediate element 24 in an articulated manner around two axes C1, C2 relative to the rotary element 17. The first bearing 20 forms a first joint which enables a pivot movement of the intermediate element 24 relative to the holding elements 19, 19' around an axis C1, said axis C1 arranged parallel to the horizontal axis A2. A second joint 25 enables a pivot movement of the hydraulic cylinder 16 relative to the intermediate element 24 around a second axis C2, which is arranged at a right angle to the first axis C1. The upper end of the hydraulic cylinder 16 is pivotably supported via a further joint 26 around a pivot axis C3 on the carrier element 27, on which the mast 7 is mounted.

The tilting movement is achieved by extending the hydraulic cylinder 16. As the two bearing points C1 and C3 are arranged distanced from the tilting axis A2, a torque around the tilting axis A2 is produced by extending the hydraulic cylinder 16, which leads to a raising of the carrier element 27 and of the telescopic mast 7 connected thereto. During the raising movement the hydraulic cylinder 16 pivots around the upper and lower bearing assemblies 20, 26. The bearing assembly 20 of the hydraulic cylinder 16 and the bearing assembly 22 of the tilting element 23 are both arranged on the rotary element 17, i.e. on different sides in relation to the vertical axis A1. As a whole, the rotating device 6, the tilting device 15 and the carrier element 27, connected thereto, form an assembly unit, which has only one connection point relative to the undercarriage, namely the rotating device.

The carrier element 27 is pivotably supported in relation to the tilting element 23 by a pivot device 28 around a pivot axis A3. The pivot axis A3, which extends at a right angle to the horizontal tilting axis A2, is formed by a pivot bearing 36 between the carrier element 27 and the tilting element 23. For pivoting the carrier element 27 around the bearing 36, a pivot drive 29 is provided, which mainly comprises a hydraulic cylinder. A first end of the hydraulic cylinder 29 is pivotably supported on the tilting element 23 by a bearing assembly 30. The second end of the hydraulic cylinder 29 is pivotably supported on the carrier element 27 by a bearing assembly 32. By an extending movement of the hydraulic cylinder 29, the carrier element 27 is moved clockwise relative to the tilting element 23. By retracting the hydraulic cylinder 29, the carrier element 27 is moved anti-clockwise in opposite direction of rotation.

The pivot movement is achieved by extending the hydraulic cylinder 29. As the two bearing assemblies 30, 32 are arranged distanced to the pivot axis A3, a torque around the pivot axis A3 is produced by extending or retracting the hydraulic cylinder 29, which leads to a pivoting of the carrier element 27 and of the telescopic mast 7 connected thereto. When extending the hydraulic cylinder 29, the carrier element 27 is pivoted clockwise, when seen in driving direction of the drilling apparatus; when retracting it is pivoted anti-clockwise. The point of attack of the bearing 30 is arranged on a radial projection on the pivot element 23. The pivot axis A3 extends at a right angle to the tilting axis A2, i.e.—in vertical operational position of the telescopic mast 7—with a small distance above the tilting axis A2. When the rotating device is not activated, i.e. the mast assembly being in a straight forward position (α=0°), the tilting axis A2 is positioned between the axis of rotation A1 and a pivot plane, which is formed by the pivot bearing 36 between the tilting element 23 and the support element 27.

The first mast portion 11 is held longitudinally displaceably via a guiding mechanism 31 on the carrier element 27. For moving the mast portion 11, respectively the telescopic mast 7, relative to the carrier element 27, a servo drive 34 is provided, which is mounted at the upper end on the mast portion 11 and is supported with a lower end relative to the carrier element 27. The telescopic second mast portion 12 is mounted longitudinally displaceably on the first mast portion 11, which again supports the slidable carriage 13 of the rotary head 14. The two mast portions 11, 12 are formed as support profiles.

FIGS. 3*a* to 3*c*, which are described together, show the small drilling apparatus 2 in an operational position, in which the tilting element 23 and therewith the carrier element 27 as well as the mast 7 are pivoted around the tilting axis A2 by an angle β of 90° from the horizontal. In this position, the mast 7 has a vertical alignment. The carriage 13 is in an upper position, so that drill rods 33 (shown in a dotted line) can be accommodated in the rotary head 14. In FIG. 3*a*, the servo drive 34, by which the first mast portion 11 can be longitudinally displaced relative to the carrier element 27, is visible at the upper end of the first mast portion 11. The servo drive 34 is provided in the form of a hydraulic cylinder, which can also be designated as the mast displacement cylinder. Corresponding guide tracks 31, in which the basic mast is laterally guided, are provided as guides between the carrier element 27 and the mast 11.

In FIG. 3*c* further details of the small drilling apparatus 2 are visible. Here, the rotary element 17 is visible in a top view, which can be rotated around the vertical axis A1 by the hydraulic rotary drive 21. The two chain drives 35, 35' are respectively laterally expandable, so that a good stability is achieved during driving. The radius between the vertical axis A1 and the drill axis F is larger than half of the width of the crawler chassis in the expanded condition. In this way, also bores, which are arranged neighboring the small drilling apparatus 2 laterally, can be drilled. Furthermore, support elements 5 are visible, which provide a good stability during the drilling process and which support the forces, introduced by the telescopic mast 7 into the main carrier 4, relative to the stationary ground. Thus, the undercarriage is not influenced by these forces.

FIGS. 4*a* to 4*c*, which are described in the following together, show the drilling apparatus 2 in a position with the telescopic mast 7 pivoted clockwise by an angle α of 90° relative to the position shown in FIG. 3*c*. The largest distance of the support element 5, arranged on the same side, to the center plane M of the small drilling apparatus corresponds more or less to the radius R of the telescopic mast 7 or of the carriage 13 attached thereon, together with the rotary head 14. Because of the pivotability of the telescopic mast 7 around the vertical axis A1, a special flexibility in view of the arrangement of bores to be produced, is achieved. Especially, also bores close to the walls of the building can be produced, without having to move the drill rig. Thus, in total shorter processing times are achieved.

The comparison of FIG. 4*c* with FIG. 3*c* shows, that the main carrier 4 is also telescopic. A first carrier portion 40 is visible, relative to which a second carrier portion 41, on which the rotary element 17 is mounted, is axially displaceably held. For this, a guide mechanism and a servo drive are provided so as to be effective between the first carrier portion 40 and the second carrier portion 41. Because of the displaceability of the carrier portion 41 and of the rotary element 17, connected rigidly thereto, the latter can be brought into a position, in which the vertical axis A1 is arranged at a distance to the chassis. In this manner, a large pivot range a of up to ±90° in relation to the vehicle center plane M is achievable for the telescopic mast 7 together with the carriage 13 and the rotary head 14.

FIG. 5 shows the drilling apparatus 2 according to FIG. 3*b* in a front view, with a telescopic mast 7, pivoted relative to the vertical basic position by an angle γ. The pivot angle γ is approximately 30°, i.e., the longitudinal axis of the mast, respectively the axis of rotation F of the rotary head 14, enclose an angle γ of approximately 30° with a vertical axis. In this pivot position, also bores, arranged at an incline, can be produced. The pivot movement is achieved by the pivot device 28, i.e. by an extending movement of the hydraulic cylinder 29, one end of which being supported on the carrier element 27 and the other end of which being supported on the tilting element 23. It is obvious, that also any smaller but also any larger angle γ than the shown 30° can be taken-up.

FIGS. 6*a* and 6*b* are described in the following together. They show the drilling apparatus 2 in a position, corresponding to that of FIGS. 3*a* and 3*b*, wherein in contrast thereto, the telescopic mast 7 is presently in the highest position. For this, a first servo drive 37 is provided in the form of a hydraulic cylinder, which lower end is supported on the first mast portion 11 and which upper end is supported on the second mast portion 12. From the hydraulic cylinder 37 the piston rod 38 is visible, which is mounted on the upper end of the telescopic mast 12 via a joint 39. The slidable carriage 13 is moved into the highest position on the movable mast portion 12. This is achieved via a second hydraulic cylinder 42, which is shown in dashed lines and which one end is supported on the mast portion 12 and which second end is connected to the carriage 13 and accommodated in the telescopic mast portion 12. Here it is provided, that the first hydraulic cylinder 37 and the second hydraulic cylinder 42 for displacing the carriage 13 are designed such that they can move with the same feed rate. In this manner, during drilling of the bore as well as during the extracting of the drill rods, a constant speed is achieved during the movement between the two mast portions 11, 12 as well as between the telescopic mast 12 and the carriage 13. In this manner, a constant drill feed and a constant input of suspension into the ground is achieved independently of actuating a first or second hydraulic cylinder, respectively.

FIG. 7 shows the drilling apparatus 2 in a front view, corresponding to the view shown in FIG. 6*b*. In FIG. 7 (as in FIG. 5), the telescopic mast 7 is turned from the vertical basic position, when seen in longitudinal direction of the vehicle, clockwise around an angle γ of approximately 30°. This means, the longitudinal axis of the mast, respectively the axis of rotation F of the rotary head 14, enclose with a vertical axis an angle γ of approximately 30°. Inclined bores can also be produced in this pivot position. The pivot movement is carried out by the pivot device 28, i.e. by extending the hydraulic cylinder 29, which is supported on the carrier element 27 with one end and on the tilting element 23 with the other end thereof.

The invention claimed is:

1. A drilling apparatus for producing bores in the ground, comprising:

a main carrier;

a telescopic mast with an adjustable length;

a rotating device pivotably coupling the telescopic mast to the main carrier around a vertical axis, the rotating device has a rotary element and a rotary drive, wherein the rotary element is rotatingly driveable relative to the main carrier around the vertical axis by the rotary drive;

a tilting device coupled to the telescopic mast and the rotating device, the tilting device configured to pivot the telescopic mast around a horizontal tilting axis, the tilting device comprising a tilting element that is connected to the rotary element so as to be pivotably supported around the horizontal tilting axis, and a tilting drive that is supported against the rotary element and that is configured to pivot the tilting element, wherein the tilting drive is connected to the rotary element with an intermediate element so as to be articulateable around two axes, with the intermediate element connected to the rotary element so as to be pivotable around a first axis, and the tilting drive connected to the intermediate element so as to be pivotable around a second axis;

wherein the main carrier includes a first carrier portion, and a second carrier portion telescopically coupled to the first carrier portion so as to be axially movable relative thereto, wherein the rotating device is coupled to the second carrier portion.

2. The drilling apparatus according to claim 1, wherein the length of the telescopic mast is continuously adjustable to accommodate drill rods with a length from 0.5 m to 2.5 m.

3. The drilling apparatus according to claim 1, wherein the telescopic mast is pivotable relative to the main carrier around the vertical axis across an angle range of up to ±90° in relation to a center position.

4. The drilling apparatus according to claim 1, further comprising a pivot device coupled to the telescopic mast and the tilting device, the pivot device configured to pivot the telescopic mast around a pivot axis, wherein the pivot axis is orthogonal to the tilting axis.

5. The drilling apparatus according to claim 4, wherein the pivot device comprises a carrier element which is connected to the tilting element so as to be rotatably supported around the pivot axis, and a pivot drive for pivoting the carrier element, with the pivot drive supported against the tilting element.

6. The drilling apparatus according to claim 5, wherein the tilting drive has a first end which is pivotably supported on the rotary element and a second end which is pivotably supported on the carrier element.

7. The drilling apparatus according to claim 5, wherein at least one of the rotary drive, the tilting drive and the pivot drive is hydraulically actuated and comprises a hydraulic cylinder.

8. The drilling apparatus according to claim 1, further comprising a first hydraulic cylinder coupled to the telescopic mast, wherein the telescopic mast has a first mast portion and a second mast portion, the second mast portion being telescopic relative to the first mast portion, and the first hydraulic cylinder is configured to move the second mast portion relative to the first mast portion.

9. The drilling apparatus according to claim 8, further comprising:

a carriage with a rotary head configured for driving drill rods on the second telescopic mast portion; and a second hydraulic cylinder coupled to the carriage, wherein the second hydraulic cylinder is configured to move the carriage along the second mast portion.

10. The drilling apparatus according to claim 9, wherein the first hydraulic cylinder and the second hydraulic cylinder are configured to move at equal feed speeds.

11. The drilling apparatus according to claim 1, wherein the drilling apparatus has a maximal width of 760 mm and a maximal height of 1900 mm.

* * * * *